US012571196B2

(12) United States Patent
Gruendl et al.

(10) Patent No.: US 12,571,196 B2
(45) Date of Patent: Mar. 10, 2026

(54) VACUUM TOILET AND TANK THEREFOR

(71) Applicant: EOOS NEXT GMBH, Vienna (AT)

(72) Inventors: Harald Gruendl, Vienna (AT); Federico Fiermonte, Rome (IT); Oscar Estrada Leon, Vienna (AT); Georg Sampl, Vienna (AT)

(73) Assignee: EOOS NEXT GMBH, Vienna (AT)

( * ) Notice: Subject to any disclaimer, the term of this patent is extended or adjusted under 35 U.S.C. 154(b) by 228 days.

(21) Appl. No.: 18/288,816

(22) PCT Filed: Jun. 14, 2022

(86) PCT No.: PCT/AT2022/060198
§ 371 (c)(1),
(2) Date: Apr. 28, 2024

(87) PCT Pub. No.: WO2022/261688
PCT Pub. Date: Dec. 22, 2022

(65) Prior Publication Data

US 2025/0198145 A1 Jun. 19, 2025

(30) Foreign Application Priority Data

Jun. 14, 2021 (AT) ..... A 50475/2021

(51) Int. Cl.
*E03F 1/00* (2006.01)
*E03D 5/00* (2006.01)

(52) U.S. Cl.
CPC ..... *E03F 1/006* (2013.01); *E03D 5/00* (2013.01)

(58) Field of Classification Search
CPC .... E03F 1/006–007; E03D 5/00; E03D 5/014; E03D 11/00
See application file for complete search history.

(56) References Cited

U.S. PATENT DOCUMENTS 2,434,027 A * 1/1948 Whittington ..... F04F 1/06 417/144
3,362,136 A * 1/1968 Burnham, Sr. ..... E21B 21/067 96/195

(Continued)

FOREIGN PATENT DOCUMENTS

AT 521114 A 10/2019
EP 0644299 A 3/1995

(Continued)

*Primary Examiner* — David P Angwin
*Assistant Examiner* — Nicholas A Ros
(74) *Attorney, Agent, or Firm* — Andrew Wilford

(57) ABSTRACT

The invention relates to a vacuum tank (1) for a vacuum toilet, which tank comprises an inlet opening (2) which is located in a side wall of the tank and can be connected to the main drain (4) of a bowl (5) via a valve (3), and comprises an outlet opening (6) located at the deepest point for conveying the wastewater flow. The air in the tank can be vacuumed to a pressure below the atmospheric pressure via the outlet opening (6) or via additional openings in the vacuum tank (1). The vacuum tank (1) is subdivided into an upper volume (8) and a lower volume (9) by a separating element (7), the separating element (7) being arranged approximately at the height of the inlet opening (2) in the tank and forming a preferably helical, downwardly open groove (10) which extends across the periphery of the tank and, starting from the inlet opening (2), extends at least once around the horizontal periphery towards the lower volume (9). A through-opening (11) is located in the middle of the separating element (7) between the upper volume (8) and the lower volume (9). The invention also relates to a vacuum toilet having a vacuum tank (1) as described above.

12 Claims, 3 Drawing Sheets

(56) References Cited

U.S. PATENT DOCUMENTS

| | | | | | |
|---|---|---|---|---|---|
| 4,184,506 | A * | 1/1980 | Varis | E03F 1/006 | 417/144 |
| 4,865,631 | A * | 9/1989 | Stroby | B64D 11/02 | 4/380 |
| 5,133,853 | A * | 7/1992 | Mattsson | E03F 1/006 | 4/321 |
| 5,538,546 | A * | 7/1996 | Ashton | E03F 1/006 | 96/197 |
| 5,538,636 | A | 7/1996 | Gnann et al. | | |
| 5,644,802 | A * | 7/1997 | Olin | E03D 5/00 | 96/216 |
| 6,216,285 | B1 * | 4/2001 | Olin | E03F 1/006 | 4/321 |
| 2009/0077731 | A1 | 3/2009 | Hiranuma | | |
| 2010/0083832 | A1 | 4/2010 | Pondelick | | |
| 2016/0319529 | A1 | 11/2016 | Oremek | | |

FOREIGN PATENT DOCUMENTS

| | | | |
|---|---|---|---|
| EP | 0287350 | A | 10/1998 |
| WO | 2014003686 | A | 1/2014 |

* cited by examiner

VACUUM TOILET AND TANK THEREFOR

CROSS REFERENCE TO RELATED APPLICATIONS

This application is the US-national stage of PCT application PCT/AT2022/060198 filed 14 Jun. 2022 and claiming the priority of Austrian patent application A50475/2021 itself filed 14 Jun. 2021.

FIELD OF THE INVENTION

The invention relates to a vacuum tank for a vacuum toilet, where the vacuum tank has an intake port on a side wall of the tank and connectable to a main drain of a bowl via an interposed valve and an output port at the lowest point that passes out a waste-water stream, and where furthermore air in the tank is maintained at a subatmospheric pressure via the output port or via further openings in the vacuum tank.

The invention further relates to a vacuum toilet comprising a bowl with a main drain, a rinse system, a vacuum tank with an intake port arranged in a side wall and an output port arranged at the lowest point, a valve connecting the main drain of the bowl to the intake port of the vacuum tank, and a controller having at least one operator station for the user, via which a flushing process can be triggered.

PRIOR ART

Vacuum toilets are often used in vehicles, ships or trains, since they use a very small amount of flush water. In the case of a flush cycle, typically only approximately one liter of flush water is required. The bowl whose main drain is closed by a valve, is first flushed with the quantity of flush water during a flushing process, then the rinse water is sucked together with feces, urine and paper at high speed through the valve. In order that sufficient suction effect can be achieved, a vacuum container of corresponding size is necessary that is first evacuated by a pump. When the valve is opened, a rapid pressure equalization then takes place, in which the entire waste-water stream is sucked into the vacuum container. The valve is then closed and the waste-water stream is transported further out of the vacuum tank.

Due to the low water requirement, toilets of this type are also attractive for use as a separating toilet, in which waste-water streams with feces can be separated from those without feces and fed to separate treatment units. In this context, too, a particularly low flush water requirement is advantageous for further processing of the waste-water streams.

It has been found that a limiting factor for the amount of flush water to be used is the vacuum tank. It must have a certain volume of usually several liters, for example of 6 to 8 liters for an average toilet, in order to be able to provide the necessary suction for a flushing process. During the flushing process, the waste-water stream, consisting, for example, of feces, urine, paper and rinse water is sucked into the tank at high speed, as a result of which there is an explosion-like distribution over the entire inner surface of the vacuum tank upon entry into the vacuum tank, in particular in the case of a waste-water stream loaded with feces. In order that the vacuum tank, when the waste-water stream is transported further along the side walls, is not coated and is disturbed in its function, the amount of flush water cannot be further reduced.

In particular, if one wishes to use the toilet as a separating toilet, in which fecal streams with high solids content are to be supplied with high solids content, it is necessary again to significantly reduce the amount of flush water so that the fecal stream does not have to be further processed with energy-intensive measures. If, even after the vacuum tank, the waste-water streams are to be treated differently, depending on the type, the quantity of flush water must still be high enough to achieve as low a cross contamination as possible of waste-water streams one behind the other between individual rinse cycles.

OBJECT OF THE INVENTION

It is therefore an object of the present invention to provide a vacuum tank for a vacuum toilet that significantly reduces the flush water requirement. Furthermore, it is an object of the present invention to provide a vacuum toilet with a low flush water requirement, which can also be used as a separating toilet, in which the different waste-water streams can also be further processed individually after passing through the vacuum tank. Both the vacuum tank and the vacuum toilet are to be modified as little as possible with respect to known systems in terms of their construction, so that standardized components can be used to a large extent, as a result of which production costs are kept low.

This object is achieved, on the one hand, by a vacuum tank that is divided by a partition into an upper and a lower compartment, the partition being approximately level with the intake port in the tank and forming if appropriate together with a side wall section of the vacuum tank, a preferably helically shaped, downwardly open channel that, starting from the intake port, runs at least once around the circumference toward the lower compartment, and a passage extends centrally between the upper and lower compartments in the partition. Use of the partition makes it possible to significantly reduce the quantity of flush water. During the flushing process, the waste-water stream is braked away from the intake port over the longer path of the channel running along the circumference and can only spread downward into the lower compartment, as a result of which there is no explosion-like distribution in the entire interior of the vacuum tank. The waste-water stream is directed in a targeted manner to the output port arranged in the lower compartment of the vacuum tank. The upper compartment never comes into contact with the waste-water stream and is thus available solely for the build-up of a vacuum. As a result, the channel and the lower compartment can be cleaned with less rinse water per rinsing process. Tests have shown that a reduction of the amount of flush water to only 300 ml is possible and nevertheless the entire essential section of the channel and of the lower compartment can be completely washed out during a flushing process. This was possible even in the case of heavily soiled feces, as in the case of diarrhea. The passage through the partition makes it possible to use the entire interior of the vacuum tank for the provision of the vacuum for the next flushing process. In this case, the partition can be placed exactly in the middle of the vacuum tank or preferably also offset toward the lower half, for example on one third of the height.

In this case, it is a further preferred feature that the passage in the partition is funnel-shaped toward the lower compartment, and optionally the upper side of the passage is also formed as a funnel. This also ensures that there is no contamination of the upper compartment in the vacuum tank. Even if a waste-water stream were distributed at a higher speed in the lower compartment, the funnel-shaped construction of the passage ensures that virtually no liquid finds the way into the upper compartment. Even if part of the waste-water stream should pass through the passage into the upper compartment, it would again move via the passage into the lower part via an also funnel-shaped upper end of the passage on the partition. According to a further preferred feature, the partition is formed in one piece together with the lower tank section forming the lower compartment and is connected with the upper tank section by the passage. For manufacturing reasons, it may be advantageous if the partition is produced together with the tank section forming the lower compartment as a single element. In this case, the lower tank section has the intake port in the region of the partition and the output port at the lowest point. The partition forms the top surface for this tank section and has the passage extending upward. A further tank section that forms the upper tank compartment can then be connected to the lower tank section via the passage. In this case, the upper tank compartment can be configured as a funnel in its lower region toward the passage.

The object of the invention is also achieved by a vacuum toilet as described above that is characterized in that the vacuum tank is divided into an upper and a lower compartment by a partition approximately level with the intake port in the tank and, if appropriate formed together with a side wall section of the vacuum tank, with a preferably helicoidally shaped, downwardly open channel that, starting from the intake port, runs at least once around the substantially vertical side wall toward the lower compartment, and a passage extends between upper and lower compartments centrally in the partition. By providing a corresponding vacuum tank in a vacuum toilet, the advantages described above are also realized. As far as the position of the intake port on the vacuum tank and the installation of the partition, standard components can furthermore be installed, as a result of which the production costs are kept low.

In this case, it is a preferred feature that the passage in the partition tapers like a funnel toward the lower compartment and optionally the upper end of the passage is also formed as a funnel toward the partition. As already described above, this results in the advantage that virtually no part of the waste-water stream can reach or remain in the upper compartment of the vacuum tank.

As also already described above in connection with the vacuum tank, it is a further preferred feature that the partition is formed in one piece together with a lower tank section forming the lower compartment and via which the passage is connected to an upper tank portion forming the upper compartment. This can have advantages for cost-effective production.

According to a preferred embodiment, a three-way valve with an inlet and two outlets is provided downstream of the output port of the vacuum tank and can be controlled via the controller, in order to direct the waste-water stream into two different outflow lines arranged downstream, depending on whether the stream is a urine or fecal stream. A vacuum toilet designed in this way makes it possible to effectively separate different waste-water streams. Thus, for example, a waste-water stream consisting of urine, rinse water and possibly paper can be conducted into one of the outlets, whereas a waste-water stream consisting of feces, rinse water, paper and urine is conducted into the other outlet. Due to the low proportion of flush water, it is possible to achieve fecal waste-water streams that have a solids content of 7-12%. As a result, the corresponding sewage waste-water stream can be further processed in an energy-efficient manner.

According to a possible preferred variant, it is provided here that the three-way valve is switched over by input at the operator station. In the simplest case, the switching between the two outflow lines takes place already during the triggering of the flushing process. As with conventional water-saving toilets, the user has, for example, a flushing key for "small" and "large" flushing, and decides, by using the flushing key, whether or not it is a waste-water stream loaded with feces. In the present case, although the quantity of flush water is not changed, only the three-way valve is correspondingly provided, but since this type of flushing is already known to most of the users, so no new operation has to be learned and the number of incorrect uses is thereby minimized.

Alternatively, according to an alternative preferred variant, it is provided that a sensor is provided in the bowl and is connected to the controller for determining the type of waste-water stream, namely whether it is a urine or feces stream, and the three-way valve is switched by a control pulse from the controller on the basis of the sensor data. In order to exclude any user error, the correct outflow line can also be selected on the basis of a sensor that supplies corresponding information to the controller. A possible sensor is an optical sensor mounted in the bowl that detects the contents of the bowl and then reports whether it is a fecal waste-water stream or not. The measurement is also carried out during initiation of the flushing process and the determined sensor value is evaluated by the controller and the three-way valve is adjusted accordingly. It will be understood by those of ordinary skill in the art that there may be other equivalent embodiments instead of a three-way valve. For example, the vacuum tank can have two separate output ports at the lowest point, which have respective valves that can be controlled by the controller.

An additional preferred feature of the vacuum toilet is that a further diverter for discharging a large part of the urine stream is already provided in the bowl upstream of the main drain. This allows an even more effective separation of the waste-water streams. A diverter to be realized in a particularly simple manner for deriving the urine stream is disclosed, for example, in AT 521114. In the solution described therein, the urine stream is conducted directly via the bowl wall due to the teapot effect into a separate discharge line. As a result, only waste-water streams are produced at the main drain of the bowl that contain either only feces, paper and rinse water, or only paper and rinse water.

A further preferred feature is that a filter is provided in the drain line downstream of the three-way valve for the sewage-free waste-water stream. In order to expel the urine waste-water stream or to remove paper from the almost pure flush water waste-water stream, a corresponding filter can be used. In this case, there are different solutions in the prior art, such as, for example, separation via a screw, via a centrifuge or the like. In the case of separation of the urine stream already taking place in the bowl, a pure flush water stream can thus also be prepared very easily for renewed flushing after passing through the filter system, for example. As a result, the total water consumption of the vacuum toilet can be further reduced.

Finally, it is a further preferred feature that a comminuting pump is downstream of the output port and conveys the waste-water stream coming from the vacuum tank further and optionally homogenizes it, and a three-way valve with an inlet and two outlets is optionally provided downstream of the comminution pump, one of the outputs being connected to the further outflow line and the other outlet being connected via a return to the lower compartment of the vacuum tank. In particular in the case of a waste-water stream loaded with feces that for example also contains toilet paper, it is advantageous to homogenize the wastewater stream for further transport and further processing. In order to achieve sufficient homogenization, a comminution pump can be provided that pumps the waste-water stream out of the lower compartment of the vacuum tank. Due to the very low flush water volume, it may happen that a single passage through the comminution pump does not lead to sufficient homogenization, For this reason, return to the lower compartment of the vacuum tank can be provided. As a result, the relevant waste-water stream can be pumped back into the vacuum tank in the circuit and thus transported multiple times through the comminution pump, until it is completely homogenized. Subsequently, the homogenized waste-water stream is conducted into the outflow line and is fed to further treatment, as has been described for example above. The comminution pump and the duration of the recycling are also controlled by the controller.

BRIEF DESCRIPTION OF THE DRAWINGS

The invention will now be described in greater detail on the basis of embodiments and with reference to the accompanying figures. Therein.

WAYS FOR CARRYING OUT THE INVENTION

Figure 1:
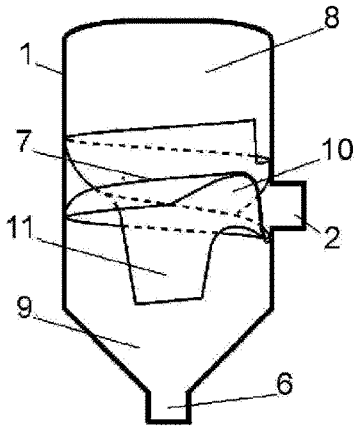
FIGS. 1 and 2 are different schematic views of a vacuum tank according to the invention.
Figure 2:
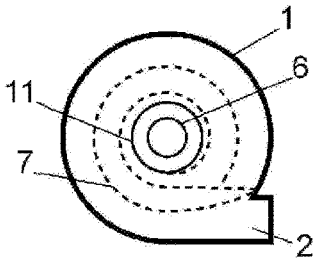

FIGS. 1 and 2 schematically illustrate a vacuum tank 1 according to the invention. In FIG. 1, the tank itself is shown in section, while a built-in partition 7 is shown completely with hidden edges shown by broken lines. FIG. 2 shows the same structure in a view from above. The vacuum tank 1 has an intake port 2 on a side wall approximately just below its vertical center. An output port 6 is located at the lowest point of the vacuum tank 1. The interior of the vacuum tank is divided by the built-in partition 7 into an upper compartment 8 and a lower compartment 9. The partition 7 forms a helicoidal channel 10 open at the bottom, and serving to brake and deflect the incoming waste-water stream from the intake port 2 around the inner surface of the vacuum tank 1 and downward to the output port 6. A passage 11 in the center of the partition 7 can be seen particularly in FIG. 2. The passage 11 tapers downward like a funnel at its lower end. In addition, the passage 11 has an upwardly flared upper end at the upper side of the partition 1. Thus, waste water can only reach the upper compartment 8 at all with difficulty and, even if it does, it is immediately returned to the output port 6 via the funnel-shaped surfaces again through the passage 11.

Figure 3:
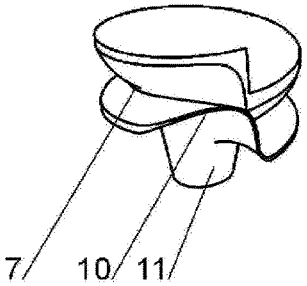
FIGS. 3 and 4 are different schematic views of a partition.
Figure 4:
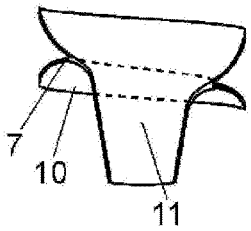

FIG. 3 shows the partition 7 alone in a perspective view and in FIG. 4 in a longitudinal section. As can be seen in the illustrated embodiment, the partition 7 is shaped like a funnel, and the open channel 10 that is in the form of a corkscrew ending at the downwardly projecting funnel tip. The partition 7 can thus be formed as a one-piece part.

Figure 5:
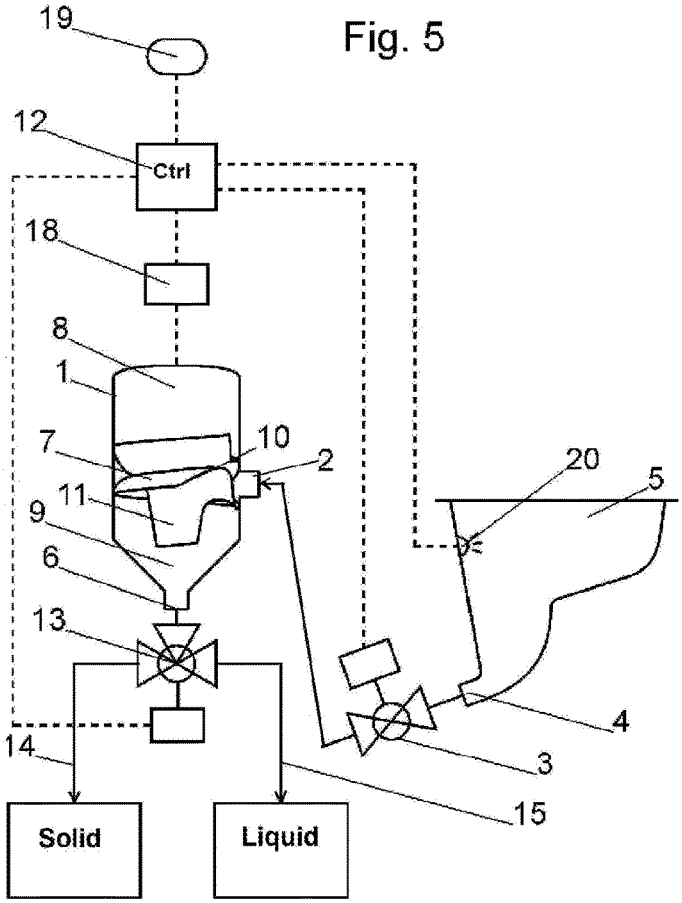
FIGS. 5 to 8 are schematic circuit diagrams of possible embodiments of vacuum toilets according to the invention with a vacuum tank.

FIG. 5 shows a schematic circuit diagram of a possible embodiment of a vacuum toilet according to the invention. A bowl 5 with a main drain 4 is connected via a valve 3 to the intake port 2 of the above-described vacuum tank 1. A three-way valve 13 having an inlet and two outputs is connected downstream of the output port 6 of the vacuum tank 1. A drain line 15 for a waste-water stream loaded with feces and a drain line 14 for a waste-water stream free of feces are provided at the two outputs. The vacuum toilet also has a controller 12 connected to an operator station 19, a vacuum pump 18, a sensor 20, and the valves 3 and 13.

A flushing process is triggered via the operator station 19. The operator station 19 can be designed such that it allows the user to select a corresponding button for the type of waste-water stream. In this case, a sensor 20 is not necessary and the three-way valve 13 is controlled by the user input. If only a single flushing key and a sensor 20 are present, the sensor 20 is activated upon actuation of the operator station 19. This then determines what type of waste-water stream is involved. The sensor 20 can for example be an optical sensor mounted in the bowl 5 and detects its contents. Rinse water is subsequently conveyed into the bowl and a vacuum is generated in the vacuum tank 1. Subsequently, the valve 3 is opened below the main drain 4 of the bowl 5 and the contents of the bowl are sucked into the vacuum tank 1. The waste-water stream is braked by the partition 7 and by the wall of the tank and is conducted into the lower compartment 9 of the vacuum tank 1. As soon as the contents of the bowl 5 have been completely aspirated, the valve 3 is closed again upstream of the intake port 2 and the three-way valve 13 is moved by the controller 12 depending on the type of waste-water stream to open to one of two drain lines 14 and 15. If necessary, a superatmospheric pressure can also be applied in the interior of the vacuum tank 1 via the pump 18 when the three-way valve 13 is open in order to push the contents of the lower compartment 9 out of the tank 1.

Figure 6:
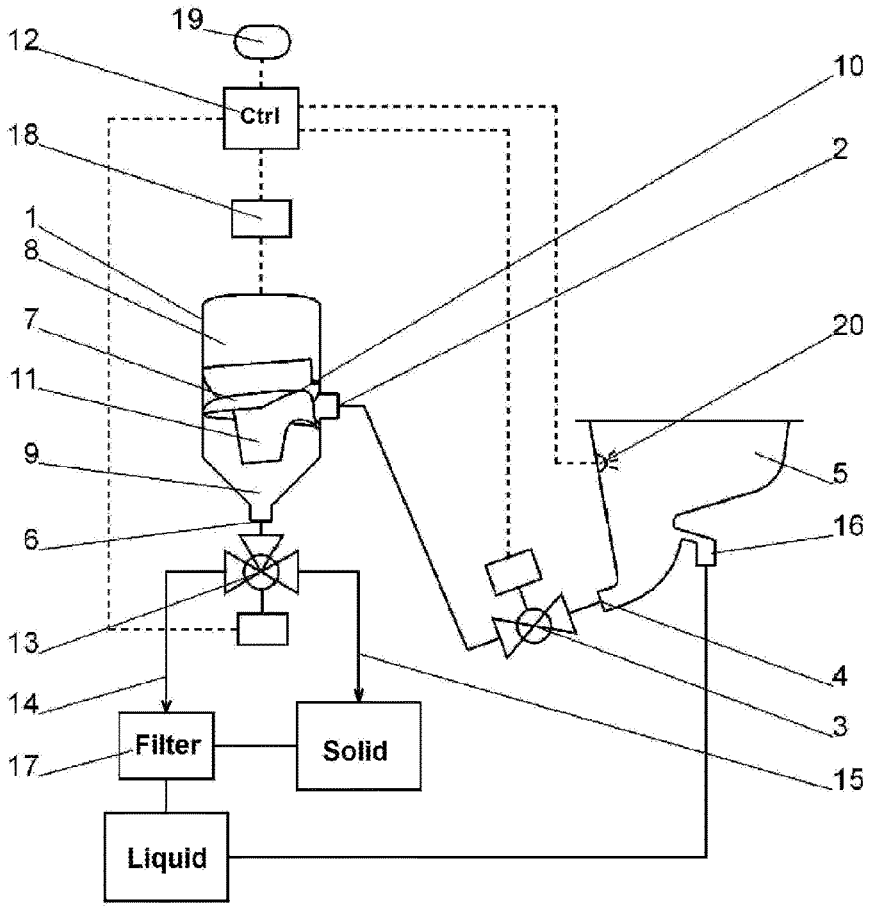

In the embodiment shown in FIG. 6, the bowl 5 has a diverter 16 that can directly intercept urine. In principle, any known diverter 16 for urine can be used in the bowl 5. It is preferably a diverter as disclosed in AT 521114 where the urine is diverted directly by the teapot effect via a bypass line in the bowl 5. The flushing process is controlled identically to what is described above in the embodiment according to FIG. 5. A further difference in the embodiment according to FIG. 6 is that a filter 17 is provided in the drain line 14 for the solids-free waste-water stream. Here, for example, toilet paper located in the waste-water stream is separated from the waste-water stream. After separation via the filter 17, the toilet paper counting as a "solid part" can be fed into the waste-water stream loaded with feces in the other discharge line 15 and processed further together therewith. The waste water-flow leaving the filter 17 here contains only more rinse water and traces of urine and is combined with the urine waste-water stream from the diverter 16 for the urine stream and further processed. However, it is also possible to recycle the flush water stream.

Figure 7:
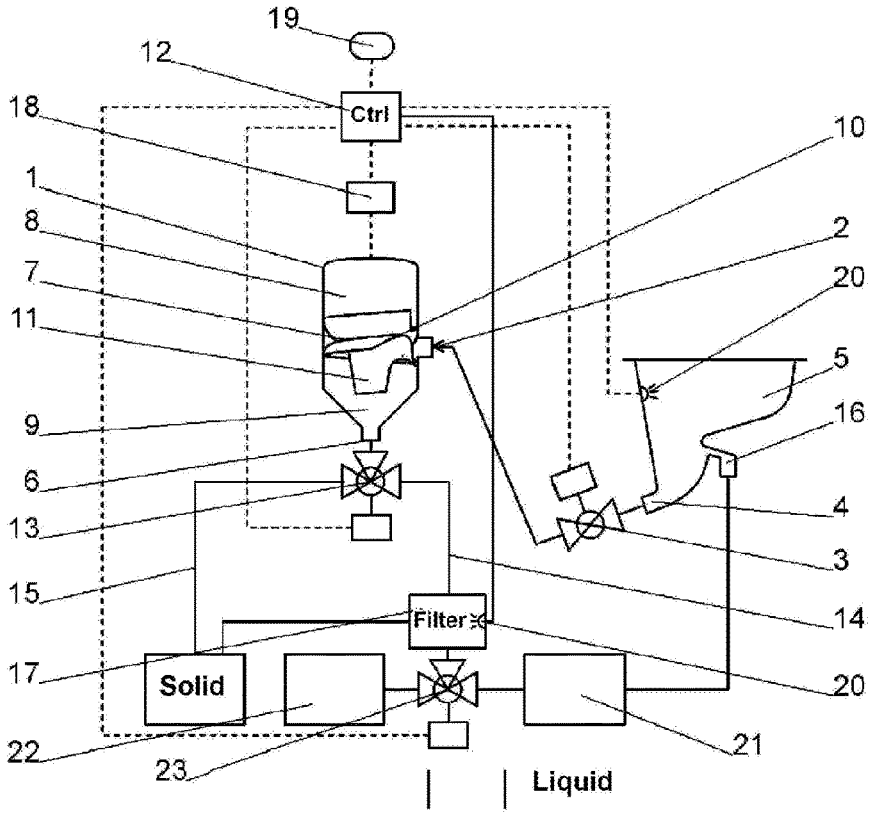

The embodiment shown in FIG. 7 has the arrangement according to FIG. 6 in the essential elements, but here a further separation of the sewage-free waste-water stream takes place downstream of the filter 17. In order to separate a waste-water stream with a largely urine fraction from a waste-water stream with an almost exclusively flush-water fraction, a further directional valve 23 is provided downstream of the filter that is also operated by the controller 12. Control of the directional control valve 23 can take place in different ways in that, for example, clean rinse cycles are separated from sewage-flushing cycles or control takes place on the basis of a further sensor 20 that is in the filter 17. This may be, for example, a conductivity sensor that measures the urine content in the waste water in the filter 17. Using this information, the controller 12 can open the directional control valve 23 either toward a flush-water treatment unit 22, or, at a higher urine content, to supply the waste-water stream to a urine stream treatment unit 21. The diverter 16 already provided in the bowl 5 for urine also opens into the urine stream treatment unit 21. As a result of the additional possibility of separation, urine waste-water streams can also be effectively distinguished and separated from flush-water streams when the toilet is used.

Figure 8:
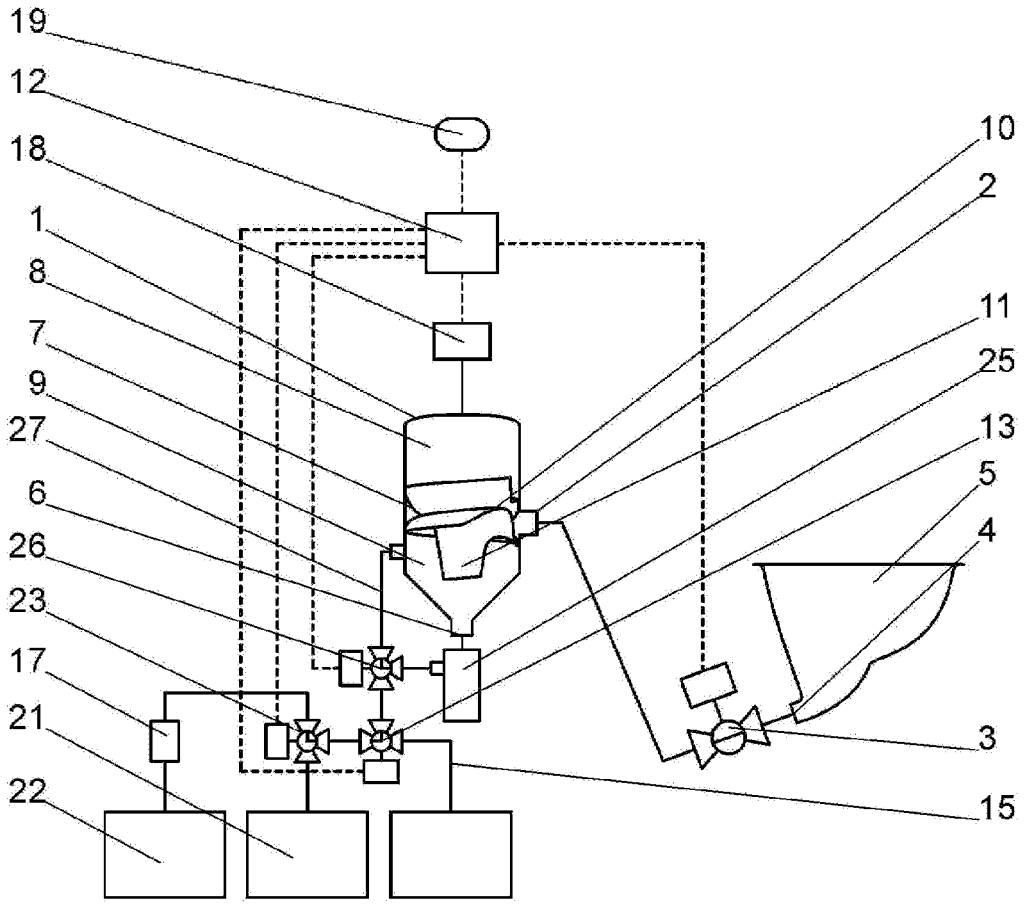

FIG. 8 shows a further possible embodiment in which the entire waste-water stream is transferred via the main drain 4 into the vacuum tank 1 and is subsequently processed into different streams. For this purpose, a comminution pump 25 is then connected to the output port 6 of the vacuum tank 1, via which the waste-water stream located in the lower compartment 9 of the vacuum tank 1 is transported further and homogenized. If it is a urine waste-water stream, it is diverted via the three-way valves 26, 13 located downstream of the comminution pump 25 and the directional control valve 23 toward a urine treatment unit 21. If it is a pure flush water stream, it is converted into a flush water treatment unit 22 via a filter 17. The filter 17 can of course also be between the three-way valve 13 and the directional control valve 23. Control of the flushing processes and the positions of the valves 26, 13 in this case, is again controlled by the controller 12 either on the basis of user inputs at the operator station 19 or on the basis of sensors 20. In order to achieve as low water consumption as possible, the waste-water streams are also largely separated from the rinsing processes. Thus, for example, in the case of a urine waste-water stream, the latter is first aspirated via the vacuum tank 1 during the flushing process and passed into the corresponding urine stream treatment. Subsequently, a separate rinse cycle occurs with ca 1 l of water that is supplied to the rinse water treatment 22.

When dealing with a waste-water stream loaded with feces, then, due to the small amount of water during the flushing process, the waste-water stream is not sufficiently homogenized during the first pass through the comminution pump 25. Here too, the flushing process is carried out separately in order to save flush water. For transporting the feces, only 0.3 l of water is used, for example. For this reason, the controller can switch the three-way valve 26 toward a return line 27 that is connected to the lower compartment 9 of the vacuum tank 7. The waste-water stream can thus be conducted several times through the comminution pump 25 in the circuit until the waste-water stream is sufficiently homogenized. Subsequently, it is diverted via the three-way valves 26, 13 toward a drain line 15 for the fecal stream. Only thereafter is there an actual cleaning rinse cycle for the bowl 5 and for the lower compartment 9 of the vacuum tank 1. For this purpose, approximately 1.5 l of flush water is used. This flush water can then also be reused via the rinse water treatment 22 on account of the low contamination. In sum, in the case of such a toilet, an extremely low total flush-water consumption of only approximately 2.6 l occurs per day as compared to about 40 l in a conventional vacuum toilet or even about 200 l in a conventional flush toilet.

Figure 9:
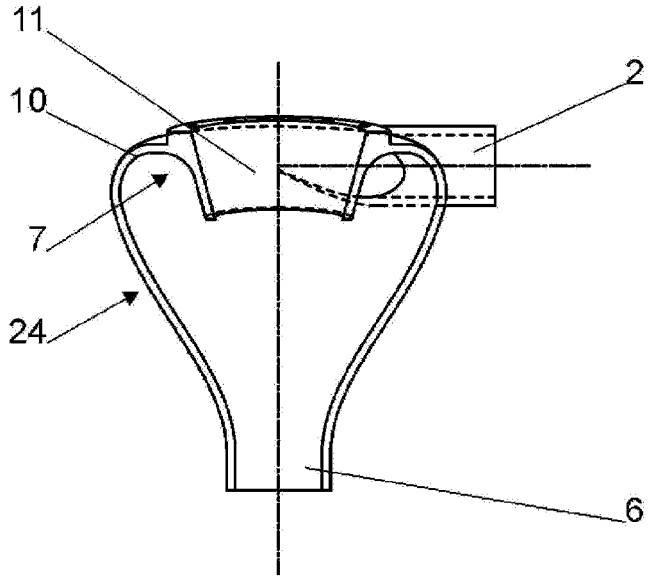
FIG. 9 is a schematic sectional view of a lower tank section with an integrated partition on the upper side.

FIG. 9 shows a schematic sectional view of a possible embodiment of a lower tank section 24. Here the lower tank section 24 is upwardly closed by and unitarily formed with the partition 7. In this case, the channel 10 is formed by the partition 7 together with the wall of the side walls of the lower tank section 24. In the lower tank section 24, the intake port 2 leads in the region of the partition 7 and the output port 6 is located at the lowest point. The passage 11, at which an upper tank portion (not shown) can be connected for increasing the evacuatable volume, is located at the top. Depending on the application and the vacuum required, upper tank sections with different geometries or volumes can thus be used. The lower tank section always remains the same, which keeps manufacturing costs low.

The present invention thus provides a vacuum toilet that on the one hand can be operated with extremely small amounts of flush water, and that, on the other hand when used as a separating toilet, produces even better separable and already concentrated waste-water streams, which also means significant energy savings for further processing of these waste-water streams.

The invention claimed is:

1. A vacuum tank for a vacuum toilet, the vacuum tank comprising:

a side wall having an intake port connectable to a drain of a toilet bowl and an output port at a lowest point of the tank;

a valve between the intake port and the drain;

means for maintaining air in the tank at a subatmospheric pressure; and a partition subdividing the vacuum tank into an upper compartment and a lower compartment, the partition being level with the intake port in the tank and forming a helicoidally shaped, downwardly open channel that, starting from the intake port runs a full turn around a circumference of an inner surface of the side wall, the partition being formed with a passage extending centrally between the upper compartment and lower compartment.

2. The vacuum tank for a vacuum toilet according to claim 1, wherein the passage in the partition tapers downward at a lower end of the passage and flares upward at an upper end of the passage.

3. The vacuum tank for a vacuum toilet according to claim 1, wherein the partition is formed in one piece together with a tank section forming the lower compartment and is connected via the passage to a tank section forming the upper compartment.

4. A vacuum toilet comprising:

a bowl with a main drain, a vacuum tank with a side wall having an intake port and an output port therebelow at a lowest point of the tank, a valve connecting the main drain of the bowl to the intake port of the vacuum tank, a controller having at least one operator station for a user for initiating a flushing process, a partition subdividing the vacuum tank into an upper compartment and a lower compartment, the partition being level with the intake port in the tank and together with a side wall section of the vacuum tank forming a helicoidally shaped, downwardly open channel that, starting from the intake port, runs a full turn around a vertical side-wall inner surface toward the lower compartment, the partition forming a passage that extends centrally through the partition between the upper compartment and lower compartment.

5. The vacuum toilet according to claim 4, wherein the passage in the partition is funnel-shaped toward the lower compartment and has an upper side formed as a funnel.

6. The vacuum toilet according to claim 4, wherein the partition is formed in one piece together with a tank section forming the lower compartment and is connected via the passage to a tank section forming the upper compartment.

7. The vacuum toilet according to claim 4, further comprising:

a further diverter for discharging most of the urine stream in the bowl upstream of the main drain.

8. The vacuum toilet according to claim 4, further comprising:

a comminuting pump downstream of the output port for conveying and homogenizing the waste-water stream coming from the vacuum tank, and a three-way valve with an inlet and two outlets downstream of the comminution pump, one of the outlets being connected to a further outflow line and the other outlet being connected to the lower compartment of the vacuum tank via a return line.

9. The vacuum toilet according to claim 4, further comprising:

a three-way valve with an inlet and two outlets provided downstream of the output port of the vacuum tank and controllable by the controller in order to direct a waste-water stream into two different downstream outflow lines depending on whether the stream is a urine or fecal stream.

10. The vacuum toilet according to claim 9, wherein the three-way valve is switched by input to the operator station.

11. The vacuum toilet according to claim 9, further comprising:

a sensor in the bowl that is connected to the controller and that detects whether the waste-water stream is a urine or feces stream, and the three-way valve is switched over by the controller on the basis of the sensor data.

12. The vacuum toilet according to claim 9, further comprising:

a filter in the outflow line downstream of the three-way valve for a sewage-free waste-water stream.

* * * * *